US006154240A

United States Patent [19]

Hickman

[11] Patent Number: 6,154,240

[45] Date of Patent: Nov. 28, 2000

[54] HARD COPY PRINT MEDIA SIZE AND POSITION DETECTION

[75] Inventor: Mark S. Hickman, Vancouver, Wash.

[73] Assignee: Hewlett-Packard Company, Palo Alto, Calif.

[21] Appl. No.: 09/294,774

[22] Filed: Apr. 19, 1999

[51] Int. Cl.[7] ..... B41J 2/01

[52] U.S. Cl. ..... 347/104; 347/138; 355/76; 271/276

[58] Field of Search ..... 347/104; 346/138; 358/448, 444; 271/276; 355/76

[56] References Cited

U.S. PATENT DOCUMENTS

| | | | |
|---|---|---|---|
| 3,617,127 | 11/1971 | McDuff | 355/73 |
| 4,145,040 | 3/1979 | Huber | 271/276 |
| 4,202,542 | 5/1980 | Lammers et al. | 271/276 |
| 4,237,466 | 12/1980 | Scranton . | |
| 4,294,540 | 10/1981 | Thettu | 355/76 |
| 4,463,361 | 7/1984 | Koumara et al. . | |
| 4,504,843 | 3/1985 | Prohl et al. . | |
| 4,630,127 | 12/1986 | Fuwa | 358/285 |
| 4,792,249 | 12/1988 | Lahr | 400/578 |
| 4,878,071 | 10/1989 | Bibl et al. . | |
| 4,921,240 | 5/1990 | Watson | 271/245 |
| 4,926,199 | 5/1990 | Bibl et al. . | |
| 4,952,950 | 8/1990 | Bibl et al. . | |
| 4,982,207 | 1/1991 | Tunmore et al. . | |
| 4,992,805 | 2/1991 | Yoshizawa et al. | 348/130 |
| 5,037,079 | 8/1991 | Siegel et al. | 271/3 |
| 5,124,728 | 6/1992 | Denda . | |
| 5,183,252 | 2/1993 | Wolber et al. | 271/276 |
| 5,197,812 | 3/1993 | Worley et al. | 400/635 |
| 5,294,965 | 3/1994 | May | 355/312 |
| 5,383,001 | 1/1995 | Bosy | 355/73 |
| 5,510,822 | 4/1996 | Vincent et al. | 347/102 |
| 5,717,446 | 2/1998 | Teumer et al. | 347/35 |
| 5,771,054 | 6/1998 | Dudek et al. | 347/102 |

*Primary Examiner*—John Barlow
*Assistant Examiner*—Alfred Dudding

[57] ABSTRACT

A method and apparatus for determining media size and width and position by detection on a vacuum platen. Detection is provided by using electrical signals from vacuum ports arranged in an X-Y array in the platen. The electrical signals are capable of interfacing with digital circuitry. The X-Y array of vacuum ports with associated detectors permit the determination of media size, shape, and position with reference to the platen, allowing printing to be contained within the media.

7 Claims, 3 Drawing Sheets

HARD COPY PRINT MEDIA SIZE AND POSITION DETECTION

BACKGROUND OF THE INVENTION

1. Field of the Invention

The present invention relates generally to hard copy apparatus. More specifically, the present invention relates to media size and position detection for a hard copy apparatus having a vacuum platen.

2. Description of Related Art

In the field of hard copy production, it is imperative Who to know the size and position of the print medium to be used. In ink-jet technology, as droplets of ink "fly" from the writing instrument to the print media, accurate print media positioning within an ink-jet hard copy apparatus print zone is even more critical. The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988). As providing background information, the foregoing documents are incorporated herein by reference.

Solutions to locate sheet media on a platen generally rely on mechanical or optical sensors. However, they are generally just a media-present or media-not-present condition indicator. None of those types of sensors create a true two dimensional profile of media on the platen.

SUMMARY OF THE INVENTION

In its basic aspects, the present invention provides a method for hard copy printing, including the steps of: providing a platen having a two dimensional grid array of proximity sensors for generating digital signals indicative of x-y coordinates on the grid; loading a sheet of print media having peripheral dimensions less than or equal to the grid array of proximity sensors onto the platen wherein only sensors subjacent the sheet of print media are activated; generating a profile of the print media sheet on the platen by determining size, shape, and position of the sheet from the digital signals indicative of x-y coordinates on the grid generated by the sensors; and printing only in locations on the sheet in accordance with the profile.

In another basic aspect, the present invention provides a media detection device for a hard copy apparatus. The device includes: a surface for receiving a variety of cut sheet print media thereon; a plurality of proximity sensors distributed across the surface in a predetermined grid pattern for generating signals indicative of alignment of sequentially loaded sheets of print media deposited on the surface; a stored map of the surface based on the predetermined grid pattern; and mechanisms for comparing current signals from the sensors indicative of alignment of a current sheet on the surface to the stored computerized map and for outputting a current sheet map based upon the comparison.

In another basic aspect, the present invention provides a wet dye printer having a transport mechanism for transporting sheet media to a printing zone within the printer. The printer includes: printing mechanisms for scanning the printing zone and depositing ink on the media in accordance with a predetermined printing algorithm; in the printing zone adjacent the printing mechanisms, a platen mechanism for retaining a sheet of the media in a fixed relationship to the printing mechanisms, the platen mechanism having two dimensional grid array of proximity sensors for generating digital signals indicative of x-y coordinates on the grid wherein only sensors subjacent the sheet of print media are activated; and associated with the printing mechanisms and the platen mechanism, computerized mechanism for storing printer controls, including the predetermined printing algorithm, a map of the grid array, and a media-position-on-platen map based on the digital signals indicative of x-y coordinates on the grid wherein only sensors subjacent the sheet of print media.

In another basic aspect, the present invention provides a method for generating a two-dimensional profile of a cut sheet print media on a vacuum platen having a plurality of gated vacuum ports arranged as a predetermined grid across the surface of the platen. The method includes the steps of: providing each of the ports with a sensor for providing signals indicative of the associated port being open or covered by a region of a current cut sheet print medium on the vacuum platen; compiling signals from covered ports into a first map indicative of current covered ports; comparing the map of current covered ports to a second map indicative of all of the gated vacuum ports arranged as a predetermined grid across the surface of the platen; and using differences between the first map and the second map to generate the two-dimensional profile of the current cut sheet print medium on the vacuum platen.

It is an advantage of the present invention that it provides both media size and location detection in a hard copy apparatus.

It is an advantage of the present invention that it any shape print media can be printed on.

It is another advantage of the present invention that print media irregularities and platen position skew are automatically determined.

It is another advantage of the present invention that it provides an economic advantage by being combined with vacuum holddown hardware relative to designing and implementing separate hardware strictly for media detection purposes.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable. For convenience of explanation, the present invention is described with respect to an exemplary embodiment comprising an ink-jet printer. As will be recognized by a person skilled in the art, the present invention has wider applicability, e.g., to any vacuum holddown system for flexible sheet materials. Use of this exemplary embodiment is not intended to be a limitation on the scope of the invention nor should any such intention be implied.

The term "paper" is used hereinafter as being synonymous with all forms of print media in the state of the art, such as plain paper, special paper, transparencies, cardstock, envelopes, and the like.

Figure 1:
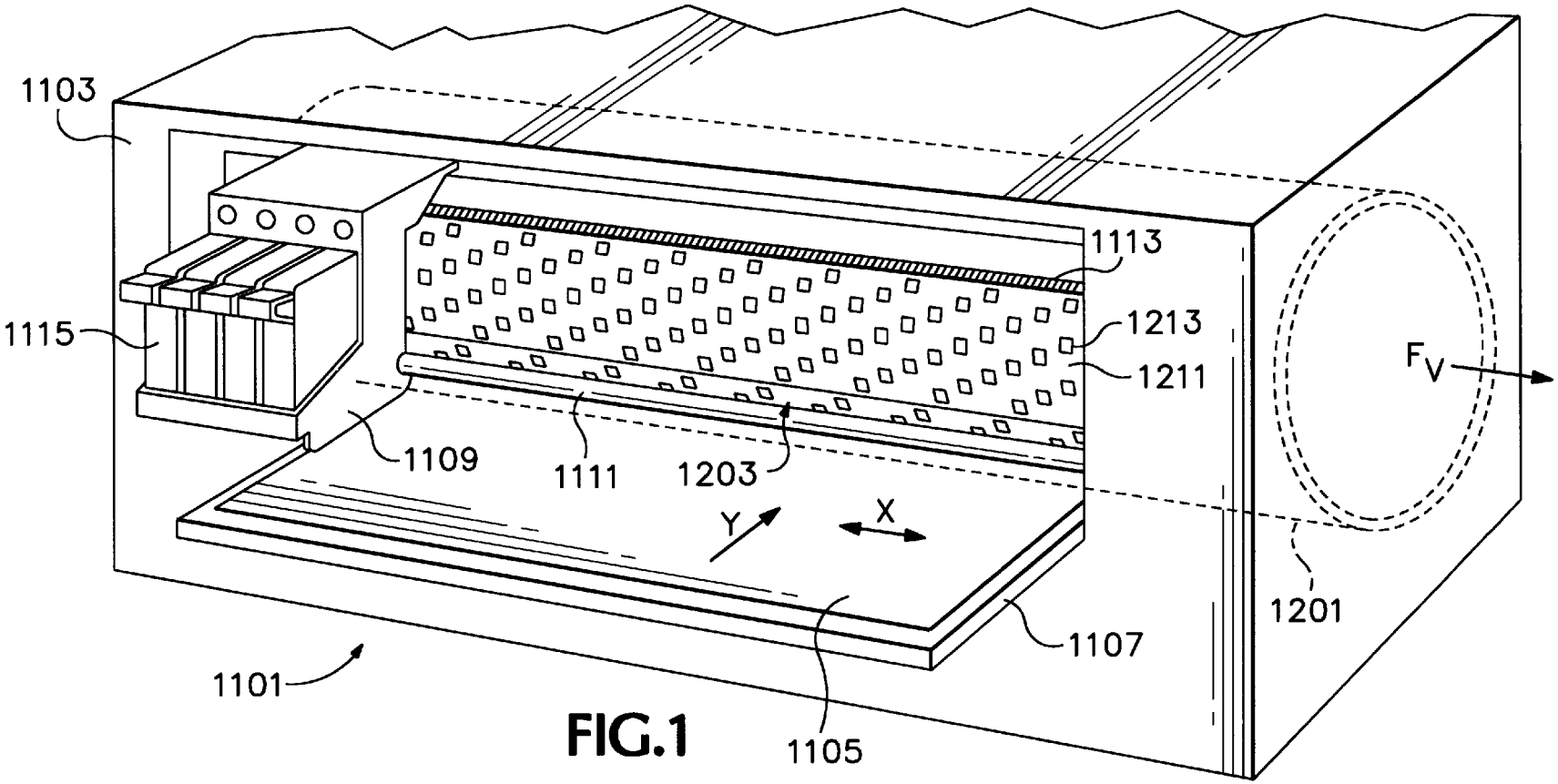
FIG. 1 is an ink-jet hard copy apparatus in accordance with the present invention.

FIG. 1 depicts an ink-jet printer 1101 which employs the present invention in connection with a vacuum holddown in the nature of a paper platen. [The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988).] The specifics of the vacuum platen printer 1101 is described in detail in the Rasmussen U.S. patent application Ser. No. 09/292,767.

In general, a housing 1103 encloses the electrical and mechanical operating mechanisms of the printer 1101. Operation is administrated by an electronic controller (usually a microprocessor or application specific integrated circuit ("ASIC") controlled printed circuit board, not shown, but see FIG. 3, 3109 and FIG. 4 described in detail hereinafter) connected by appropriate cabling to the computer (not shown). It is well known to program and execute imaging, printing, paper handling, control functions, and logic with firmware or software instructions for conventional or general purpose microprocessors or ASIC's. Cut-sheet paper 1105, loaded by the end-user onto an input tray 1107, is fed by a known manner paper-path transport mechanism (not shown) to a vacuum holddown 1201. Note that the holddown construct may have a planar or curvilinear topology as would be suitable to a particular implementation. The exemplary embodiment used to describe the present invention is shown as a rotatable drum.

The holddown 1201 captures the sheet on platen 1203 surface 1211 which moves the sheet to an internal printing station, or "printing zone." A carriage 1109, mounted on a slider 1111, scans across the vacuum-held paper in the X-axis (see labeled arrow). An encoder strip 1113 and appurtenant known manner devices (not shown) are provided for keeping track of the position of the carriage 1109 at any given time. A set of individual ink-jet pens, or print cartridges, 1115 are releasably mounted in the carriage 1109 for easy access and replacement (generally, in a full color system, inks for the subtractive primary colors, cyan, yellow, magenta (CYM) and true black (K) are provided). Each pen or cartridge has one or more printhead mechanisms (not seen in this perspective) for "jetting" minute droplets of ink to form swaths of dots on adjacently positioned paper through the printing zone where graphical images or alphanumeric text are created using state of the art dot matrix manipulation techniques. The media transport access is perpendicular to the scan axis and is therefore designated the Y-axis.

The vacuum force (arrow labeled Fv) for the platen is provided in any known manner suitable to a specific implementation. A variety of mechanisms for removing a sheet of paper on a vacuum holddown—such as blowers, selectable lift fingers, and the like—are also known in the art and can be employed in conjunction with the present invention. Further explanation is not necessary to an understanding of the present invention.

Figure 2:
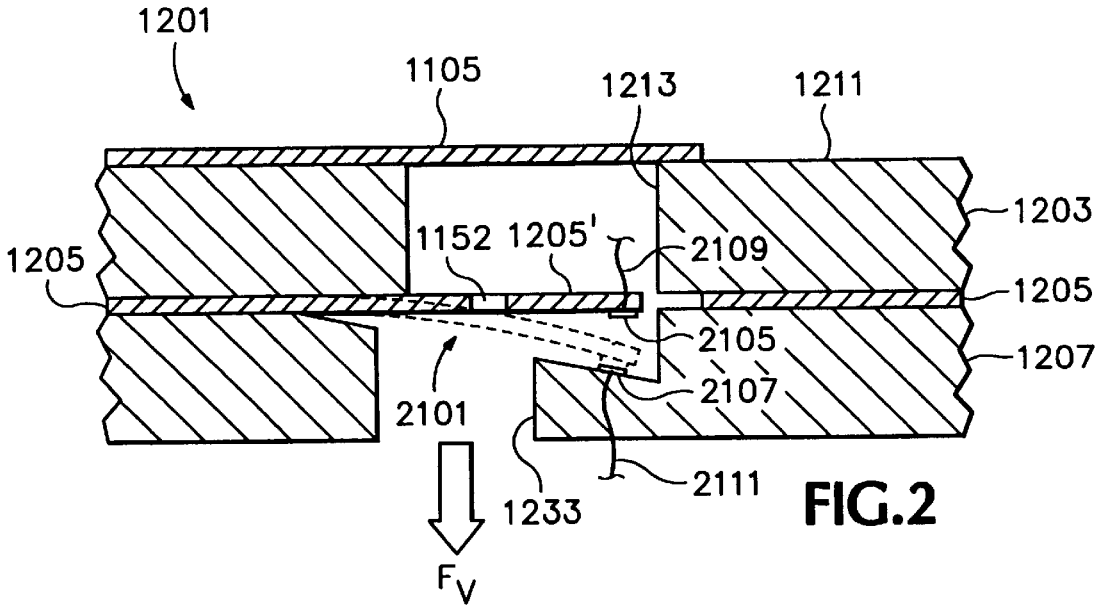
FIG. 2 is a schematic representation in a cut-away format of a section of platen from the apparatus of FIG. 1, showing a gate valved vacuum port having a media sensor device in accordance with the present invention.

The vacuum holddown 1201 surface 1211 has a field of vacuum ports 1213. Each individual port 1213 has a gate valve mechanism 2101 as shown in FIG. 2, which depicts one vacuum port gate valve mechanism of the platen holddown field.

As the leading edge of the paper 1105 begins to cover a row of vacuum ports 1213 of the platen surface 1211, the vacuum force—depicted as arrow "$F_V$"—dynamic is now altered. Once a vacuum port 1213 is closed off to the atmosphere by the paper 1105, via a leakage hole 1152 in a flexible material, gate valve plate 1205, a vacuum state now builds—nearly instantaneously—such that a vacuum exists both within vacuum port 1213 and through vacuum passageway 1233 formed through a valve cavity plate 1207 subjacent the valve gate plate 1205. A gate valve plate 1205 beam 1205' cantilevered across the vacuum passageway which is adapted to be closed (phantom line position) by the force of the vacuum, now opens under the force of its normal cantilever bias (or alternatively a known manner actual bias spring provided (not shown)). The vacuum force is applied through the open passageway 1233 and its associated vacuum port 1213 to the underside of the paper 1105.

Operationally, the change in vacuum force dynamic caused by the paper covering an area of the platen flips each covered gate between the closed and open state of the passageway and vacuum port. In other words, when a vacuum Fv is applied to the underside of the holddown during apparatus initialization, the gates close. When a sheet of material is introduced onto a region of the vacuum port field, those gates only within vacuum manifold passageway covered by the material are now configured to spring open, applying a suction force to the sheet via the now opened ports. The holddown thus automatically adjusts to material size.

Figure 3:
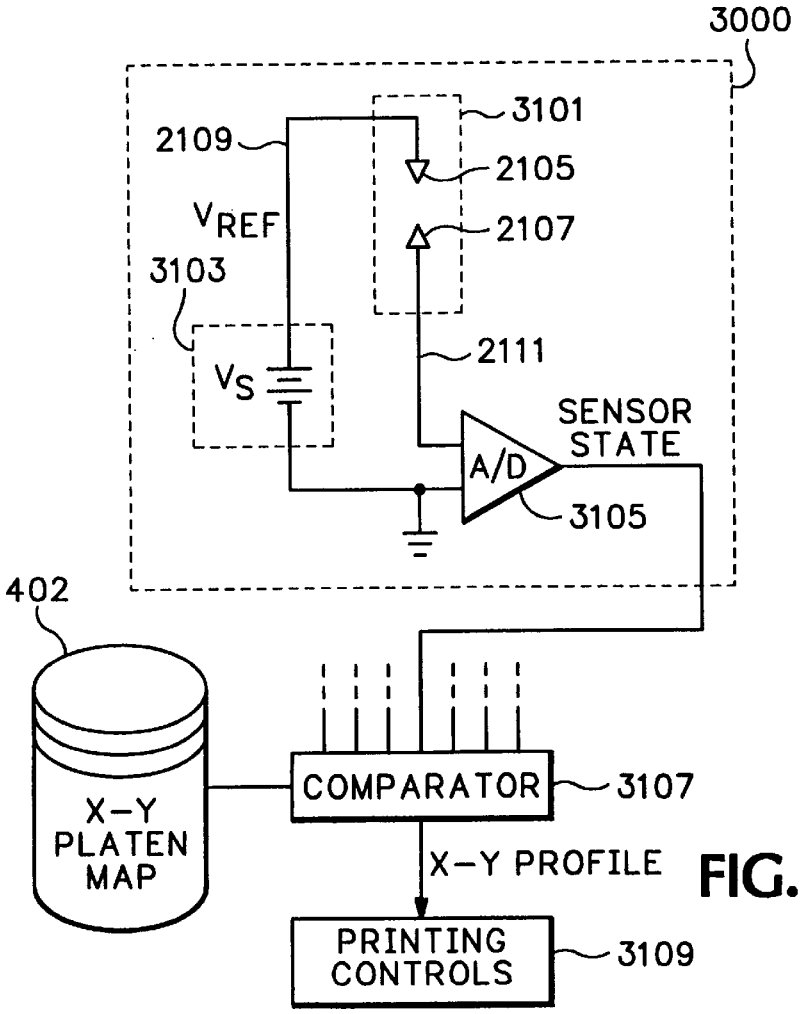
FIG. 3 is a schematic diagram for a device for detecting hard copy media size in accordance with the present invention as shown in FIG. 2.

In accordance with the present invention, each cantilevered beam 1205' and its associated valve cavity plate 1207 recess forming the gate valve mechanism 2101 are provided with a pair of electrical contact points 2105, 1207. The contact points 2105, 2107 are wired 2109, 2111 in combination to form a switch 3101 of a valve state sensor 3000 as shown in FIG. 3. Coupling a power supply 3103 to an analog-to-digital ("A/D") converter 3105, the switch 3101 when closed provides the power supply reference voltage, $V_{REF}$, to the A/D converter. The A/D converter 3105 is thus used to provide a digital signal, "SENSOR STATE," indicative of the gate valve state, open or closed, and hence whether the vacuum port 1213 is covered or uncovered, respectively.

Figure 4:
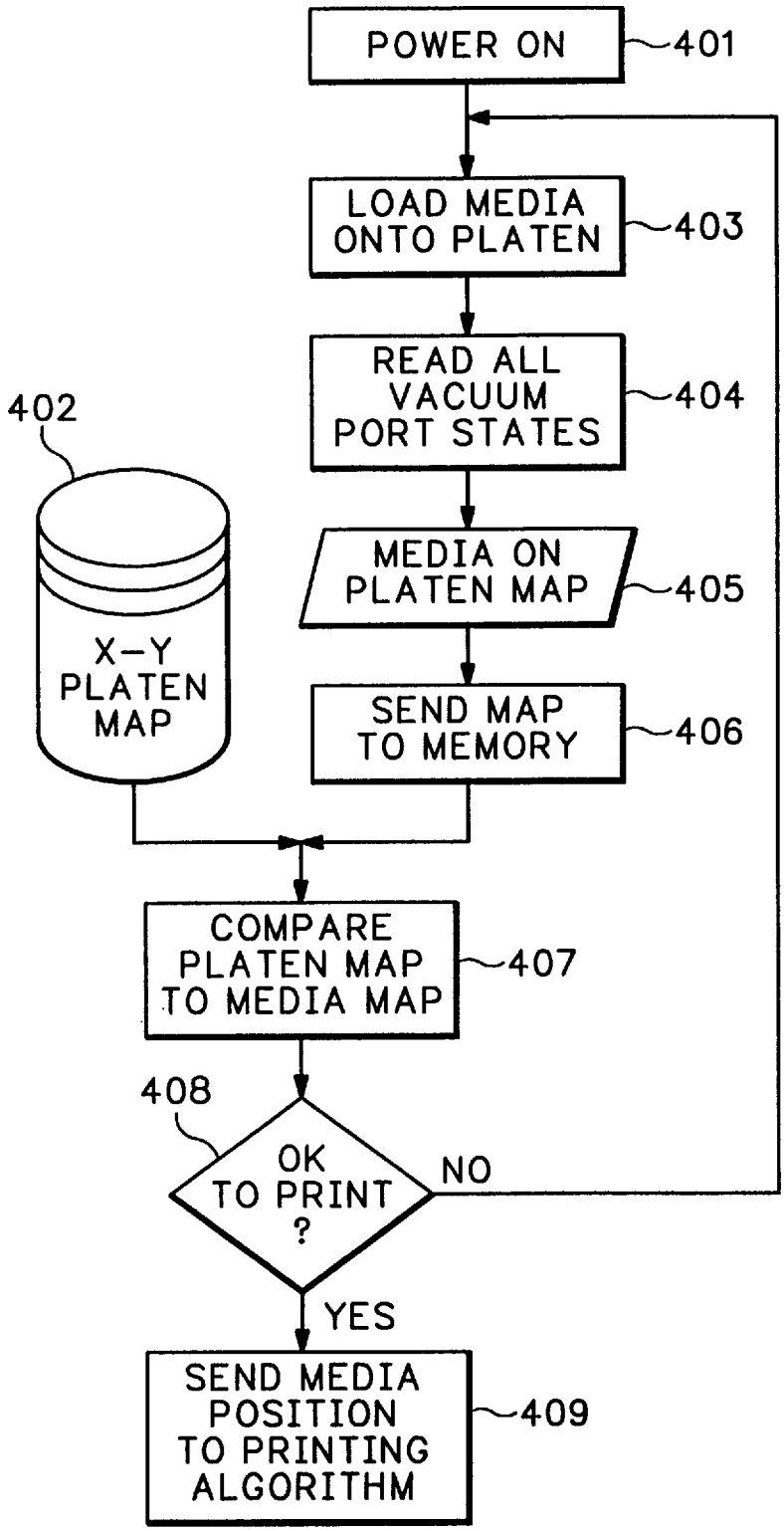
FIG. 4 is a flow chart for a method for detecting hard copy media size in accordance with the present invention as shown in FIGS. 1, 3 and 3.

Now refer also to FIG. 4, a flow chart for the methodology employed in the present invention. In step 401, power is turned and the system initialized. The driver software or firmware for the hard copy apparatus is provided with a platen map in memory, generally an x-y coordinate map, 402. In other words, the predetermined position of each gate valve is mapped in accordance with the specific implementation design. In an ink-jet printer, when a print command is issued by an application program, media is loaded onto the platen, step 403. In accordance with the embodiments shown in FIGS. 1–3, the result of a sheet of media being loaded onto the platen is that some vacuum port valves will be in an open state, some valves will be in a closed state. Each of the valves has a spatial position on the platen in accordance with the x-y platen map 402. Thus, all of the vacuum port states can be determined, step 404. The vacuum port states therefore can be used to generate an x-y coordinate map 405 of where the sheet is on the platen and its size. This media-position-on-platen map 405 is stored, step 406. The two maps, the x-y platen map 402 and the media-position-on-platen map 405, are compared, step 407, using a known manner digital comparator 3107. Determinations can then be made if printing on the media should proceed or the sheet off-loaded, step 408.

If the determination is to print (408, YES-path), the media-position-on-platen map 405 is sent to the printing she algorithm of the printer controller 3109, step 409. The size and location knowledge is then used by the printer controls to make appropriate decisions such as when to fire pens, when to initiate page-eject sequences, how to format data intended for the sensed page-size, and the like for the state of the art.

A variety of conditions may determine that printing on the current sheet of media on the platen should not proceed (408, NO-path). For example, from the comparison of the two maps 402, 405, it can be determined if the sheet is skewed on the platen. If the paper is determined from the vacuum port valve states to be skewed more than a predetermined tolerance, e.g., by one percent (viz., if the vacuum ports are a linear array with known spacing, e.g., one millimeter, having the sheet off kilter by two ports in one-hundred exceeds the tolerance), the print cycle can be aborted until a new sheet is loaded, step 403. Other readings of the vacuum port valve states might trigger indications such as that the wrong paper size was loaded, or that a sheet is damaged, or that the media is not skewed but the leading/trailing/or side edges are not properly positioned for printing, or other like conditions known in the art that could result in a misprinted page.

Thus, the present invention provides a two-dimensional profile of media size and location. Irregular sizes, shapes, or skew levels are readily detected.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A method for hard copy printing, comprising the steps of:

providing a platen having a two dimensional grid array of proximity sensors for generating digital signals indicative of x-y coordinates on the grid;

loading a sheet of print media having peripheral dimensions less than or equal to the grid array of proximity sensors onto the platen wherein only sensors subjacent the sheet of print media are activated;

generating a profile of the print media sheet on the platen by determining size, shape, and position of the sheet from the digital signals indicative of x-y coordinates on the grid generated by the sensors; and printing only in locations on the sheet in accordance with the profile.

2. A media detection device for a hard copy apparatus, comprising:

a surface for receiving a variety of cut sheet print media thereon;

a plurality of proximity sensors distributed across the surface in a predetermined grid pattern for generating signals indicative of alignment of sequentially loaded sheets of print media deposited on the surface;

a stored map of the surface based on the predetermined grid pattern; and means for comparing current signals from the sensors indicative of alignment of a current sheet on the surface to the stored computerized map and for outputting a current sheet map based upon the comparison.

3. The device set forth in claim 2, comprising:

the surface is a vacuum platen having a plurality of vacuum ports arrayed across the surface;

each of the vacuum ports includes a two position gate valve forming an electrical switch of each of the sensors such that when the valve is in a first, closed position, the sensor provides a signal indicative of no media being present at the port associated therewith, and when the valve is in a second, open position, the sensor provides a signal indicative of media being present at the port associated therewith.

4. A wet dye printer having a transport means for transporting sheet media to a printing zone within the printer, comprising:

printing means for scanning the printing zone and depositing ink on the media in accordance with a predetermined printing algorithm;

in the printing zone adjacent the printing means, platen means for retaining a sheet of the media in a fixed relationship to the printing means, the platen means having two dimensional grid array of proximity sensors for generating digital signals indicative of x-y coordinates on the grid wherein only sensors subjacent the sheet of print media are activated; and associated with the printing means and the platen means, computerized means for storing printer controls, including the predetermined printing algorithm, a map of the grid array, and a media-position-on-platen map based on the digital signals indicative of x-y coordinates on the grid wherein only sensors subjacent the sheet of print media.

5. The wet dye printer as set forth in claim 4, the platen means further comprising:

a vacuum holddown having vacuum ports distributed therethrough wherein each of the ports as a gate valve for opening and closing an associated port.

6. The wet dye printer as set forth in claim 5, the proximity sensors further comprising:

a digital signal means for generating a signal indicative of where a gate valve is open or closed.

7. A method for generating a two-dimensional profile of a cut sheet print media on a vacuum platen having a plurality of gated vacuum ports arranged as a predetermined grid across the surface of the platen, comprising the steps of:

providing each of the ports with a sensor for providing signals indicative of the associated port being open or covered by a region of a current cut sheet print medium on the vacuum platen;

compiling signals from covered ports into a first map indicative of current covered ports;

comparing the map of current covered ports to a second map indicative of all of the gated vacuum ports arranged as a predetermined grid across the surface of the platen; and using differences between the first map and the second map to generate the two-dimensional profile of the current cut sheet print medium on the vacuum platen.

* * * * *